United States Patent [19]

King et al.

[11] 4,012,801

[45] Mar. 22, 1977

[54] BOX SPRING ASSEMBLY

[75] Inventors: John Thomas King, Sarcoxie; Blondie Butler, Carthage, both of Mo.; Francis R. Struewing, deceased, late of Carthage, Mo., by Barbara C. Struewing, administratrix

[73] Assignee: Legget & Platt Incorporated, Carthage, Mo.

[22] Filed: Oct. 10, 1975

[21] Appl. No.: 621,497

[52] U.S. Cl. ..... 5/247; 5/257

[51] Int. Cl.[2] ..... A47C 23/02

[58] Field of Search ..... 267/80; 5/247, 235, 5/255, 259, 342, 351, 257, 239

[56] References Cited

UNITED STATES PATENTS

| | | | |
|---|---|---|---|
| 488,060 | 12/1892 | Bunker | 5/255 |
| 3,087,169 | 4/1963 | Melen | 5/259 |
| 3,833,948 | 9/1974 | Surletta | 5/247 |

FOREIGN PATENTS OR APPLICATIONS

| | | | |
|---|---|---|---|
| 294,962 | 4/1965 | Netherlands | 5/257 |

*Primary Examiner*—Paul R. Gilliam
*Assistant Examiner*—Andrew M. Calvert
*Attorney, Agent, or Firm*—Wood, Herron & Evans

[57] ABSTRACT

A box spring assembly for use as a foundation for a bed mattress. The assembly comprises a wooden frame, slats, spiral springs, corner coil springs, a border wire, and a welded wire top grid. The spiral springs extend parallel to the wooden slats and are secured at the bottom to the slats and at the top to the welded wire grid. Corner reinforcement and resiliency is provided by four corner coil springs, each of which is secured at the bottom to the wooden frame and at the top to the border wire and grid.

13 Claims, 4 Drawing Figures

BOX SPRING ASSEMBLY

This invention relates to bedding and more particularly to bed foundations or so-called "box springs" used for the support of bed mattresses.

Conventionally, bed foundations or "box springs" comprise a wooden rectangular base frame and transverse slats upon which coil springs are supported. The coil springs are usually tied together at the top by a wire grid or by a series of interconnecting helical wires.

Customer demand is currently directed toward a more rigid or less flexible bed foundation or box spring. To obtain this rigidity, the coils are either increased in number or in wire diameter. In either event though, the result is a box spring which is more expensive because of the increased cost of the coils.

As one approach to increasing rigidity without increasing the cost, some bedding manufacturers have completely eliminated all springs and all resiliency from the box spring, as for example, by substituting rigid foam plastic such as foam polystyrene for the springs of the unit. This has the desired effect of a cost reduction and increased rigidity but at the total sacrifice of resiliency. Ideally, some resiliency should be retained, even in the most rigid bed foundation, to achieve the most comfortable and desirable combination of bed mattress and foundation.

Accordingly, it has been a primary objective of this invention to provide an improved box spring which has increased rigidity over conventional coil spring units but which is less expensive to produce and which still retains some resiliency.

This objective is achieved and one aspect of this invention is predicated upon the concept of utilizing large diameter helical wires which extend for the length or width of the box spring as a substitute for the coil springs of a conventional box spring unit. These helical wires are secured at the bottom to transverse slats of the wooden frame and at the top to a grid of wires which extend between a border wire of the box spring. Preferably, there is a coil spring located at each of the four corners of the unit to increase the corner rigidity and resiliency of the unit. Adjacent helicals are preferably of opposite twist or lead to minimize lean or lateral shift of the top of the unit.

We are aware that there is disclosed in U.S. Pat. No. 182,797 which issued Oct. 3, 1876, a bed bottom which utilizes flat sheet metal helical springs in lieu of conventional coil springs to provide the resiliency of the unit. That approach of utilizing flat sheet metal helical springs though is impractical from both a cost and resiliency standpoint for obtaining satisfactory bedding by today's standards.

The primary advantage of the box spring unit of this invention resides in its provision of a very rigid, yet inexpensive, unit which still retains sufficient resiliency to yield under heavy loading conditions.

These and other objects and advantages of this invention will be more readily apparent from the following detailed description of the drawings in which.

Figure 1:
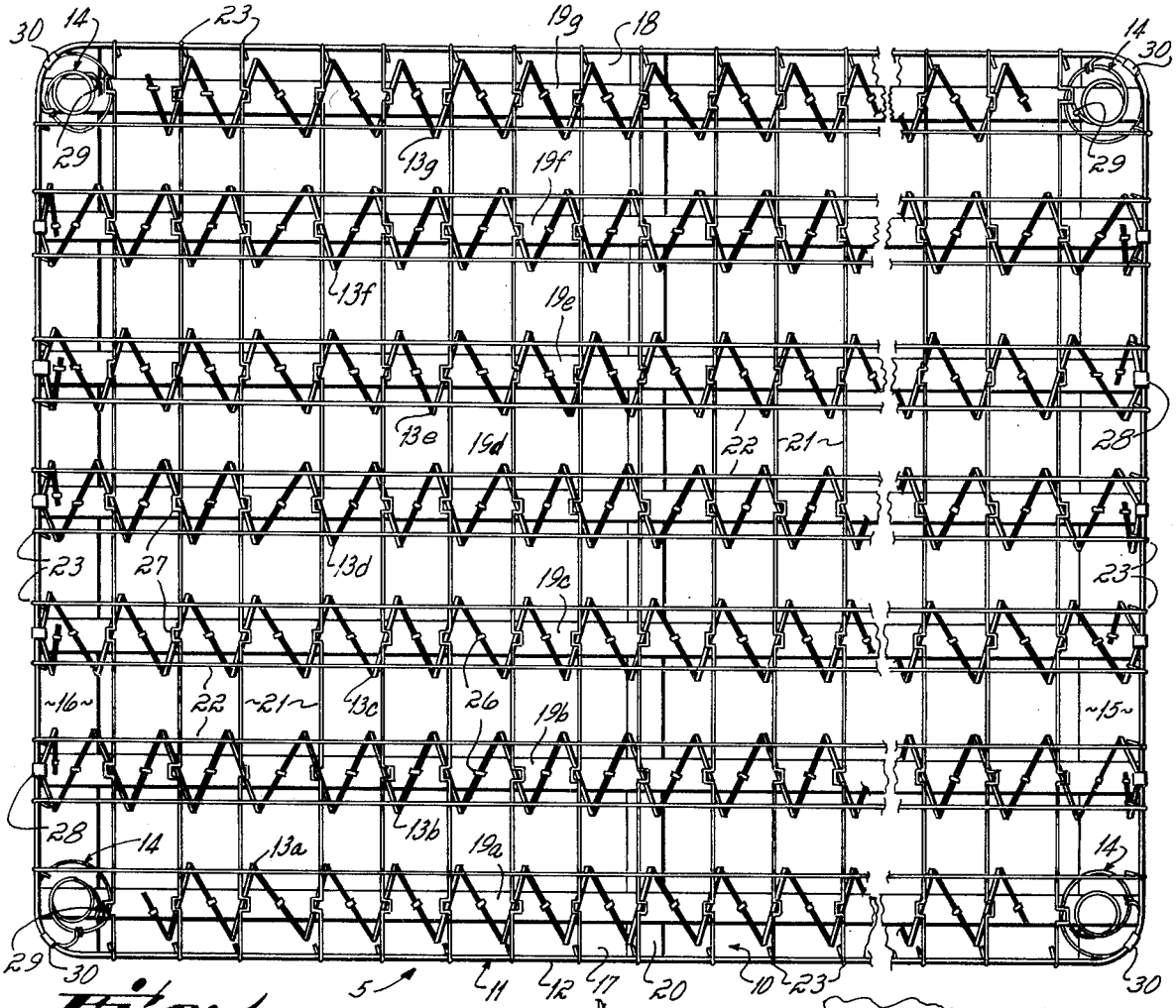
FIG. 1 is a top plan view of a box spring assembly incorporating the invention of this application.

The box spring assembly 5 of this invention comprises a wooden base 10 located in the bottom plane of the assembly, a wire grid 11 and border wire 12 located in the top plane of the assembly, and a plurality of parallel helical springs 13 located between the base frame 10 and the wire grid 11. In the preferred embodiment there are also four helical coil springs 14 located at the four corners of the assembly.

The base frame 10 comprises a pair of end boards 15, 16 and a pair of side boards 17, 18 which are stapled or nailed together to form a rectangular frame. Longitudinal slats 19*a*, 19*b*, 19*c*, 19*d*, 19*e*, 19*f* and 19*g*, extend between and are nailed to the end boards 15 and 16. There is preferably a transverse slat 20 nailed to the top side of the side board 17 and 18 and located beneath the longitudinal slats 19*a* through 19*g*. This transverse slat 20 provides support for the longitudinal slats approximately midway of their length.

The border wire 12 is formed into a rectangular configuration which overlies the peripheral edge of the rectangular frame elements 15, 16, 17 and 18. The wire grid 11 is secured to and located in the plane of the border wire 12. It comprises a plurality of transverse wires 21 and longitudinal wires 22 which extend between opposite sides of the rectangular border wire. At the ends, both the transverse wires 21 and longitudinal wires 22 wrap around the border wire 12, as illustrated at 23. Preferably the ends of both the transverse wires 21 and the longitudinal wires 22 are welded to the border wire. The intersections of the transverse wires 21 and longitudinal wires 22 are also preferably welded together.

In practice, the border wire and top grid are all preformed into a welded wire subassembly. This subassembly is manufactured by placing the transverse wires 21, longitudinal wires 22 and border wire 12 within a fixture, and there spotwelding all of the intersections of the transverse wires 21, longitudinal wires 22 and border wire 12.

The resiliency of the box spring assembly 5 is afforded by long helical wires 13*a* through 13*g* which extend between the opposite ends of the assembly. These helical wires generally are mounted atop each of the wooden slats 19*a* through 19*g* and are secured to the slats and to the welded wire grid 11. In one preferred embodiment the helical wire is of six inch diameter and has a pitch of four inches. Each revolution of the helical wires 13*a* through 13*g* is secured at the bottom to the slats 19*a* through 19*g* respectively by conventional metal staples 26 and is secured at the top to the welded wire grid by a generally U-shaped hook 27 pre-formed into the transverse wire 21 of the welded wire grid. The hooks 27 are formed as open U-shaped elements which open downwardly so that the grid may be placed over the helical wires with the upper portions of each loop located in one of the hooks. The open portions of the U-shaped configuration are then bent to a closed condition so as to lock the helical wires within the U-shaped sections of the transverse wires 21.

With reference to FIG. 1, it will be seen that the helical wires 13*b*, 13*c*, 13*d*, 13*e* and 13*f* extend for the full length of the box spring assembly. The last revolution of each of these helicals 19*b* through 19*f* is attached at the top to the border wire 12 by a conventional metal clip 28 and is stapled at the bottom to the slats 19*b* through 19*f* respectively. The endmost helical wires 13*a* and 13*g* terminate short of the ends of the assembly. In practice, the two side edge helical wires 13*a* and 13*g* are foreshortened by two revolutions are each end. This foreshortening of these two coils provides a space for reception of the helical coils 14 at each corner of the assembly.

Each of the helical coils 14 is generally conical in shape when viewed in side elevation. Each coil has its smaller diameter end convolution secured to the top of one of the slats 19*a* and 19*g* by a staple 29. At the top the largest revolution of the coil is clipped to the border wire by a conventional metal clip 30.

The primary advantage of the box spring assembly heretofore described resides in the fact that it enables a very firm box spring assembly to be manufactured relatively inexpensively. The assembly though retains sufficient resiliency to yield under heavy loading conditions. The inclusion of the helical springs 13 in place of a conventional coil springs of a box assembly provide this rigidity without a total sacrifice of resiliency. The coil springs 14 at the four corners of the assembly though provide additional resiliency at the corners, where such resiliency is desirable.

Figure 2:
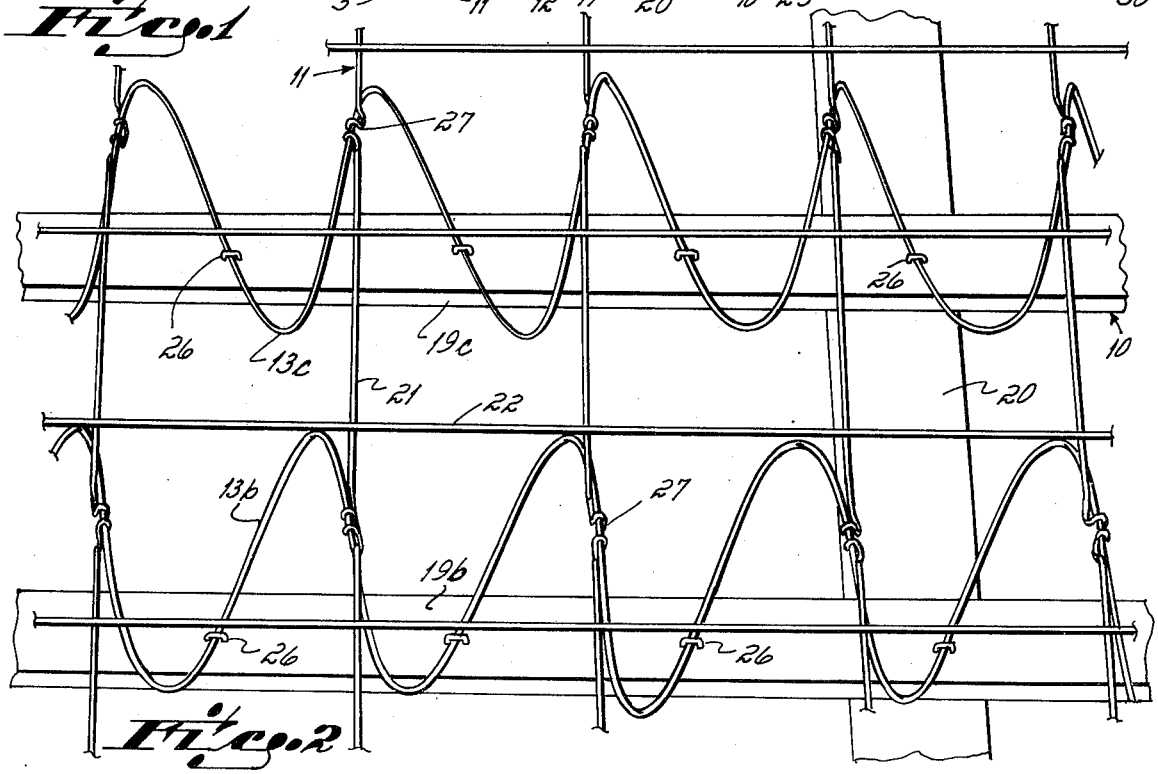
FIG. 2 is an enlarged top plan view of a portion of the box spring assembly of FIG. 1.
Figure 3:
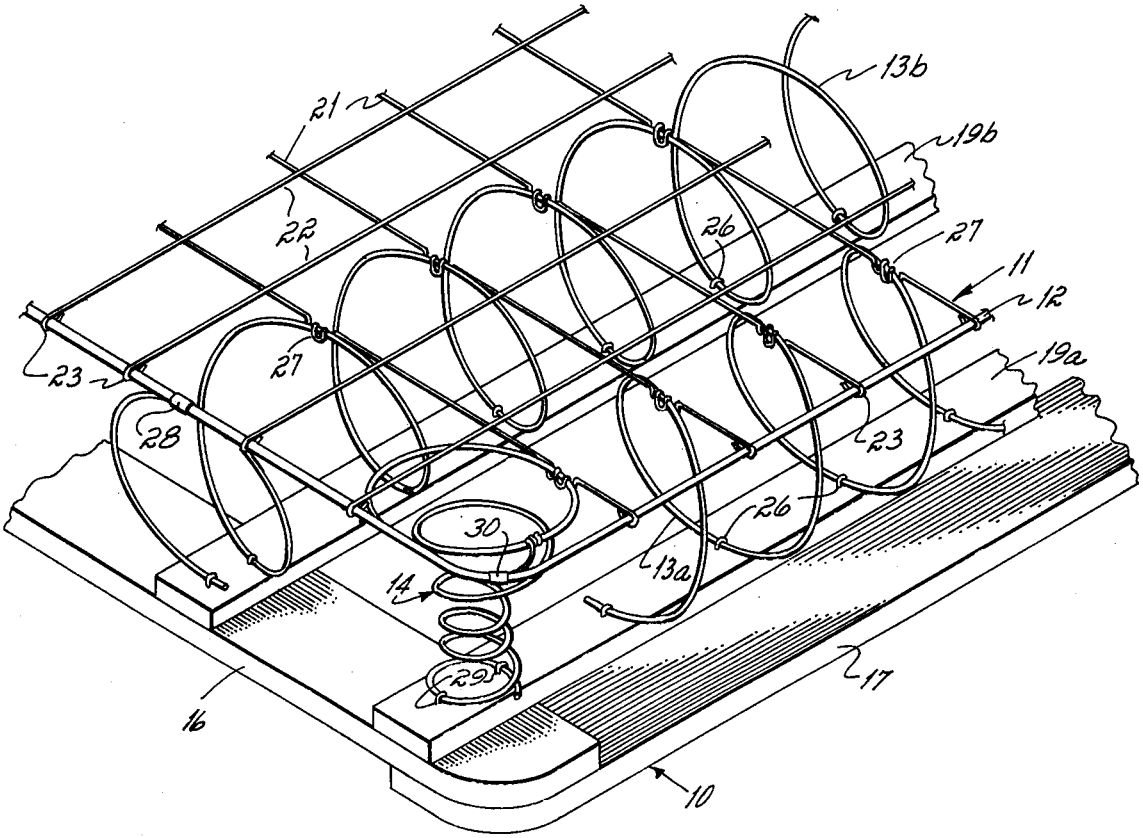
FIG. 3 is a perspective view of a portion of the box spring assembly of FIG. 1.
Figure 4:
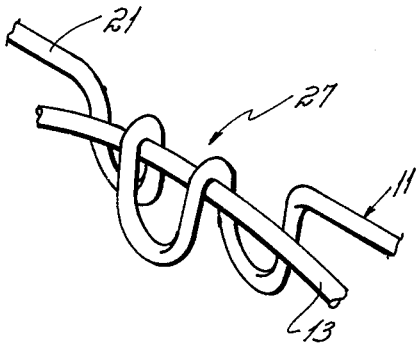
FIG. 4 is an enlarged perspective view of a connector between the spiral spring and wire grid of the box spring assembly of FIG. 1.

We have found that if the helical springs 13 are all wound in the same direction, that is they all have a counterclockwise or clockwise lead, there is a tendency for the top wire grid to shift laterally when a load is placed on the top of the box spring assembly. To minimize this lateral shifting or "sway" of the unit, it will be seen in FIGS. 1, 2, and 3 that adjacent helical springs of the assembly have opposite leads or pitches. In other words, with reference to these figures it will be seen that when viewed from the left end, the helical wires 13*a*, 13*c*, 13*e* and 13*g* all have a counterclockwise lead while the other helical springs 13*b*, 13*d* and 13*f* all have a clockwise lead. These opposite leads or pitches of the adjacent helical springs eliminate side sway which would be present if all of the springs 13 were of the same pitch.

While we have described only a single preferred embodiment of our invention, persons skilled in the box spring art will appreciate numerous changes or modifications which may be made without departing from the spirit of our invention. For example, the helical springs could extend transversely rather than longitudinally of the unit or the unit could include both longitudinal and transverse helicals. Accordingly, we do not intend to be limited except by the scope of the following appended claims:

Having described our invention, we claim:

1. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires welded together at their intersections and secured at their opposite ends to said border wire, and a plurality of parallel spiral spring wires extending between opposite sides of said base frame, said spiral spring wires being secured at the bottom to said slats and at the top to said wire grid.

2. The box spring assembly of claim 1 which further includes coil springs located at the corners of said box spring assembly, said coil springs being secured at the bottom to said base frame and at the top to said border wire.

3. The box spring assembly of claim 1 in which at least some of said longitudinal and transverse wires of said grid have generally U-shaped hooks formed therein, said U-shaped hooks being wrapped around said spiral wires so as to secure said spiral spring wires to said grid of wires.

4. The box spring assembly of claim 1 in which each revolution of said spiral spring wires is connected at the top to said grid and at the bottom to one of said slats.

5. The box spring assembly of claim 1 in which each of said spiral spring wires extends parallel to one of said slats.

6. The box spring assembly of claim 1 in which adjacent spiral spring wires of said plurality of parallel spiral spring wires are of opposite twist so as to minimize lateral movement of the grid of wires upon vertical loading of said box spring assembly.

7. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires secured at their opposite ends to said border wire, a plurality of parallel spiral spring wires, each of said spiral spring wires extending between opposite sides of said base frame, said spiral spring wires being secured at the bottom to said slats and at the top to said wire grid, and coil springs located at the corners of said box spring assembly, said coil springs being secured at the bottom to said base frame and at the top to said border wire.

8. The box spring assembly of claim 7 in which at least some of said longitudinal and transverse wires of said grid have generally U-shaped hooks formed therein, said U-shaped hooks being wrapped around said spiral spring wires so as to secure said spiral spring wires to said grid of wires.

9. The box spring assembly of claim 7 in which each revolution of said spiral spring wires is connected at the top to said grid of wires.

10. The box spring assembly of claim 7 in which each of said spiral spring wires extends parallel to one of said slats.

11. The box spring assembly of claim 7 in which adjacent spiral spring wires of said plurality of parallel spiral spring wires are of opposite twist so as to minimize lateral movement of said grid of wires upon vertical loading of said box spring assembly.

12. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires welded together at their intersections and secured at their opposite ends to said border wire, and a plurality of parallel spiral spring wires extending between opposite sides of said base frame, said spiral spring wires being secured at the bottom to said slats and at the top to said wire grid, and adjacent spiral spring wires of said plurality of parallel spiral spring wires being of opposite twist so as to minimize lateral movement of said grid of wires upon vertical loading of said box spring.

13. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to plane of said base frame, a grid of wires located in the plane of said border wire and defining the top plane of said box spring assembly, said grid comprising a plurality of longitudinal and transverse wires secured at their opposite ends to said border wire, a plurality of parallel helical spring wires, each of said helical spring wires extending between opposite sides of said base frame, said helical spring wires being secured at the bottom to said slats and at the top to said wire grid, and each of said parallel helical spring wires having an axis extending parallel to said top plane of said box spring.

* * * * *